US011293614B2

(12) United States Patent
Moser et al.

(10) Patent No.: US 11,293,614 B2
(45) Date of Patent: Apr. 5, 2022

(54) PROJECTION APPARATUS CONSISTING OF A PLURALITY OF MICRO-OPTICAL SYSTEMS, AND LIGHTING MODULE FOR A MOTOR VEHICLE HEADLAMP

(71) Applicant: ZKW Group GmbH, Wieselburg (AT)

(72) Inventors: Andreas Moser, Perg (AT); Bernhard Mandl, Ober-Grafendorf (AT); Friedrich Bauer, Bergland (AT)

(73) Assignee: ZKW GROUP GMBH, Wieselburg (AT)

( * ) Notice: Subject to any disclaimer, the term of this patent is extended or adjusted under 35 U.S.C. 154(b) by 0 days.

(21) Appl. No.: 17/264,975

(22) PCT Filed: Aug. 5, 2019

(86) PCT No.: PCT/EP2019/070975

§ 371 (c)(1),
(2) Date: Feb. 1, 2021

(87) PCT Pub. No.: WO2020/030568

PCT Pub. Date: Feb. 13, 2020

(65) Prior Publication Data

US 2021/0325016 A1 Oct. 21, 2021

(30) Foreign Application Priority Data

Aug. 7, 2018 (EP) ..... 18187726

(51) Int. Cl.
*F21V 5/00* (2018.01)
*F21S 41/265* (2018.01)
(Continued)

(52) U.S. Cl.
CPC ..... *F21S 41/265* (2018.01); *F21S 41/143* (2018.01); *F21S 41/43* (2018.01); *F21S 41/663* (2018.01)

(58) Field of Classification Search
CPC ..... F21S 41/265; F21S 41/663; F21S 41/143; F21S 41/43
See application file for complete search history.

(56) References Cited

U.S. PATENT DOCUMENTS 10,612,741 B2 * 4/2020 Moser ..... F21S 41/285
2018/0106445 A1 4/2018 Okubo
(Continued)

FOREIGN PATENT DOCUMENTS

DE 102013227194 A1 7/2015

OTHER PUBLICATIONS

International Search Report for PCT/EP2019/070975, dated Nov. 4, 2019. (2 pages).
European Search Report for EP Application No. 18187726, dated Feb. 8, 2019. (1 page).

*Primary Examiner* — Matthew J. Peerce
(74) *Attorney, Agent, or Firm* — Eversheds Sutherland (US) LLP

(57) ABSTRACT

Disclosed is a projection apparatus (2) for a lighting module (1) of a motor vehicle headlamp, the projection apparatus (2) being formed by a plurality of micro-optical systems (3) that are arranged like a matrix; each micro-optical system (3) includes a micro-input optical element (30), a micro-output optical element (31) associated with the micro-input optical element (30), and a micro-diaphragm (32), all micro-input optical elements (31) forming an input optical unit (4), all micro-output optical elements (31) forming an output optical unit (5), and the micro-diaphragms (32) forming a diaphragm device (6); the diaphragm device (6) is disposed in a plane extending substantially perpendicularly to the main direction of emission (Z) of the projection apparatus (2), while the input optical unit (4), the output optical unit (5) and the diaphragm device (6) are disposed in planes extending substantially parallel to one another; all of the micro-
(Continued)

optical systems (3) are subdivided into at least two micro-optical system groups (G1, G2, G3), and the micro-diaphragms (32) of the micro-optical systems (3) of each micro-optical system group (G1, G2, G3) can be projected in focus by means of light having at least one optical wavelength (λG, λG2, λG3) lying within a predefined optical wavelength range, the predefined optical wavelength ranges being different in different micro-optical system groups (G1, G2, G3).

18 Claims, 4 Drawing Sheets

(51) Int. Cl.

| | |
|---|---|
| ***F21S 41/663*** | (2018.01) |
| ***F21S 41/143*** | (2018.01) |
| ***F21S 41/43*** | (2018.01) |

(56) References Cited

U.S. PATENT DOCUMENTS

| | | | |
|---|---|---|---|
| 2018/0199017 | A1 | 7/2018 | Michaelis et al. |
| 2018/0320852 | A1 | 11/2018 | Mandl |
| 2019/0072252 | A1 | 3/2019 | Moser et al. |

* cited by examiner

PROJECTION APPARATUS CONSISTING OF A PLURALITY OF MICRO-OPTICAL SYSTEMS, AND LIGHTING MODULE FOR A MOTOR VEHICLE HEADLAMP

The invention relates to a projection apparatus for a lighting module of a motor vehicle headlamp, which is formed from a plurality of micro-optical systems arranged in a matrix-like manner, wherein each micro-optical system has a micro-input optical element, a micro-output optical element associated with the micro-input optical element, and a micro-diaphragm arranged between the micro-input optical element and the micro-output optical element, wherein all the micro-input optical elements form an input optical unit, all the micro-output optical elements form an output optical unit, and the micro-diaphragms form a diaphragm device, wherein the diaphragm device is arranged in a plane substantially orthogonal to the main radiation direction of the projection apparatus, and the input optical unit, the output optical unit and the diaphragm device are arranged in planes substantially parallel to each other.

Furthermore, the invention relates to a lighting module with at least one such projection apparatus.

Projection apparatuses of the type cited above, and lighting modules with such projection apparatuses, are known from the prior art.

The applicant's international application WO 2015/058227 A1 shows a micro-projection lighting module in which individual projection systems—projection apparatuses—are aligned in series. With each individual projection system, a sharp image of a complete light distribution, for example a dipped beam light distribution, is generated. The design of a single micro-optical system, from which the projection systems are formed, is carried out for the wavelength of approx. 555 nm, that is to say, for the green colour range.

This range is sharply imaged, whereas all other wavelength ranges have blurred images due to chromatic aberration. In the case of a dipped beam distribution, for example, this leads to a violet colour fringe at the bright/dark boundary. In such a projection system, the colour of the colour fringe can only be adjusted by deliberately defocusing the projection systems by altering the position of the micro-output optical elements. However, this leads, for example, to a large gap between the dipped beam distribution and a partial full beam distribution that is clearly visible to the naked eye (if the lens is defocused in the direction of the beam diaphragm), or to the colour fringe becoming even bluer (if the lens is defocused away from the beam diaphragm (diaphragm device)). Other solutions, such as achromatic lenses, are too complex and expensive to produce, since they require a specific combination of materials.

It is therefore the object of the present invention to eliminate the disadvantages of the prior art, and to provide a projection apparatus and a lighting module that compensate for the colour fringe.

The object is achieved with a projection apparatus of the above-cited type in accordance with the invention, in that the entirety of the micro-optical systems is divided into at least two micro-optical system groups, wherein the micro-diaphragms of the micro-optical systems of each micro-optical system group can be sharply imaged by light of at least one light wavelength from a predefined light wavelength range, preferably by light of one predefined light wavelength, and the predefined light wavelength ranges are different for different micro-optical system groups, and preferably do not overlap.

By this means one, preferably exactly one, light wavelength is assigned to each micro-optical system group. Each micro-optical system group is thus characterised by a light wavelength from a predefined light wavelength range, preferably by one predefined light wavelength. Furthermore, it can be said that one of the micro-optical system groups only focuses light of at least one light wavelength from a predefined light wavelength range, preferably one predefined light wavelength. Other micro-optical system groups are defocused with respect to the light of one light wavelength from this predefined light wavelength range, preferably the predefined light wavelength.

The light distributions generated by means of the projection apparatus are formed as a superposition of a plurality of micro-light distributions—light distributions that are formed by individual micro-optical systems. Furthermore, each micro-optical system group is set up so as to form a partial light distribution. The partial light distributions are superpositions of those micro-light distributions that are formed/shaped with the aid of the micro-optical systems belonging to the corresponding micro-optical system group. The light distribution, that is to say, the complete light distribution, is also a superposition of the partial light distributions of individual micro-optical system groups.

The above-cited sharp imaging of the micro-diaphragms, for example of their optically active edges, in the light of at least one light wavelength from the specified light wavelength range, preferably the specified light wavelength, results in micro-bright/dark transitions or boundaries in the light image, which have colour fringes in different colours. By a superposition of the micro-bright/dark transitions or boundaries, the colour fringes in the light image are also superposed, whereby a colour compensation effect is achieved, in which the colour of a colour fringe is adapted to the summated light distribution, that is to say, to the complete light distribution. The predefined light wavelength ranges, in particular the predefined light wavelengths, are preferably selected in such a way that a white colour fringe is created.

This enables colour compensation without an achromat, any special positioning of the micro-output optical elements, any additional process steps, or any additional components.

Furthermore, provision can advantageously be made that in each micro-optical system the micro-diaphragm is spaced apart from the micro-output optical elements by a distance, wherein the distance depends on the at least one light wavelength from a predefined light wavelength range, preferably one predefined light wavelength, and is substantially the same within the same micro-optical system group, wherein the distances are different for the micro-optical systems from different micro-optical system groups.

This means that within one and the same micro-optical system group, the micro-diaphragms can be spaced apart from the respective micro-output optical elements by the same distance, wherein this distance is selected in accordance with at least one light wavelength from the predefined light wavelength range assigned to this micro-optical system group, preferably at least one predefined light wavelength. Here the micro-optical systems from two or more different micro-optical system groups can have two or more different distances between their micro-diaphragms and the respective micro-output optical elements. Each micro-optical system group can be set up so as to sharply image micro-diaphragms in the light of at least one light wavelength from a predefined light wavelength range, preferably one predefined light wavelength.

Furthermore, it can be appropriate if differences between the distances in different micro-optical system groups are from about 0.01 mm to about 0.12 mm, preferably from about 0.01 mm to about 0.06 mm, in particular from about 0.01 mm to about 0.03 mm, wherein the micro-output optical elements have a focal length—the distance between the focal point and the light-input surface—which depends on the at least one light wavelength from a predefined light wavelength range and on its diameter.

For example, micro-output optical elements can be designed for green light. If, for example, the micro-output optical elements are designed as plano-convex lenses with a lens diameter of about 2 mm, they can have a focal length of about 0.7 mm ("green focal point") for light with a light wavelength of about 555 nm ("green light") (see example in the figures description).

It should be noted at this point that the position of the micro-diaphragms in a micro-optical system group can be tuned to a predefined range of light wavelengths associated with that micro-optical system group, preferably to one wavelength of light. For example, if the micro-optical system group is to image the micro-diaphragms for green light (from the green region of the spectrum with light wavelengths from about 490 nm to about 575 nm: $\lambda$~490-575 nm, in particular $\lambda$~555 nm), the position of the intermediate image plane for these wavelengths is determined, and the micro-diaphragms of the micro-optical system group are then positioned in the green intermediate image plane, that is to say, at the point of intersection of the green beams with the optical axis of the micro-output optical elements. In doing so, the micro-diaphragms have a distance from the micro-output optical elements that is tuned to the green light, and is thus related to the corresponding light wavelength.

The optically active edges within the same micro-optical system group can be sharply imaged with light from a predefined light wavelength range, preferably one predefined light wavelength. This means that the bright/dark transition(s), for example bright/dark boundary(ies), generated by the optically active edges have a colour fringe of a corresponding colour.

Advantageously, provision can be made for the micro-output optical elements of each micro-optical system to have a light-output surface with a predefined curvature, wherein the predefined curvature (the value of the predefined curvature) depends on the at least one light wavelength from a predefined light wavelength range, preferably one of the predefined light wavelengths, and is substantially the same within the same micro-optical system group, wherein the predefined curvatures are different for the micro-optical systems from different micro-optical system groups.

Provision can also be made for at least some of the micro-diaphragms of each micro-optical system group to have optically active edges designed so as to image a substantially horizontal (with or without an asymmetric slope) micro-bright/dark boundary.

There can be further advantages if the micro-bright/dark boundaries can be sharply imaged for different micro-optical system groups by light of the different light wavelengths.

With regard to the accommodation of the micro-optical system group in a motor vehicle headlamp, it can be useful if the different micro-optical system groups are designed separately from each other, and are preferably spaced apart from each other.

Furthermore, provision can advantageously be made for the micro-diaphragms of each micro-optical system group to be combined into a micro-diaphragm group and the micro-diaphragm groups to be identically designed, wherein each micro-diaphragm is preferably formed as a platelet of an opaque material with an aperture, wherein in particular each micro-diaphragm has a finite thickness along the main radiation direction, for example from about 0.01 mm to about 0.12 mm, preferably from about 0.06 mm.

Furthermore, the above-cited object is achieved with a lighting module with at least one projection apparatus in accordance with the invention, wherein the lighting module also has a light source, wherein the projection apparatus is located downstream of the light source in the light emission direction, and projects substantially all of the light generated by the light source into a region in front of the lighting module in the form of a light distribution with a bright/dark boundary, wherein the light distribution is formed from a multiplicity of mutually overlapping partial light distributions, each with a partial bright/dark boundary, and each partial light distribution is formed by exactly one micro-optical system group.

Furthermore, provision can be made for each partial bright/dark boundary to have a colour fringe of a given colour and different partial bright/dark boundaries to have colour fringes of different colours.

It can be appropriate if the partial bright/dark boundaries and the bright/dark boundary run substantially straight, for example horizontally or vertically, or have an asymmetric slope, wherein each colour corresponds to a light wavelength from a predefined light wavelength range, preferably one predefined light wavelength.

In a practical form of embodiment, provision can be made for the light source to be set up so as to generate collimated light.

Furthermore, provision can advantageously be made for the light source to comprise a light-collimating optical element and a preferably semiconductor-based lighting element, for example an LED light source, located upstream of the light-collimating optical element, wherein the light-collimating optical element is, for example, a collimator or a light-collimating optical attachment, or a TIR lens.

Furthermore, provision can be made for the light source to have at least two light-emitting regions, wherein each individual light-emitting region can be controlled independently of the other light-emitting regions of the light source, e.g. can be switched on and off, and at least one, preferably exactly one micro-optical system group is assigned to each light-emitting region in such a way that light generated by the respective light-emitting region directly, and only impinges on the micro-optical system group assigned to this light-emitting region. This enables a dynamic adjustment, i.e. adjustment during operation of the lighting module, of the colour of the colour fringe of the bright/dark boundary.

The invention, including further advantages, is explained in more detail below on the basis of exemplary forms of embodiment, which are illustrated in the figures. Here:

FIG. 1 shows a perspective view of an illumination device with a projection apparatus consisting of a plurality of micro-optical systems;

FIG. 1*a* shows an exploded view of one of the micro-optical systems of FIG. 1;

FIG. 1*b* shows a cross-section A-A of the micro-optical system of FIG. 1*a;*

The figures are schematic illustrations that show only those components that can be helpful in explaining the invention. The person skilled in the art will immediately recognise that a projection apparatus and a lighting module for a motor vehicle headlamp can have a multiplicity of further components that are not shown here, such as adjustment and setting devices, means of electrical supply, and much more.

To simplify the readability, and where appropriate, the figures are provided with reference axes. These reference axes refer to a professional installation position of the subject matter of the invention in a motor vehicle, and represent a motor vehicle-related coordinate system.

Furthermore, it should be clear that directional terms, such as "horizontal", "vertical", "above", "below", etc., are to be understood in a relative sense in the context of the present invention, and refer either to the above-cited professional installation position of the subject matter of the invention in a motor vehicle, or to a customary alignment of a radiated light distribution in the light image, that is to say, in the traffic environment.

Thus, neither the reference axes nor the directional terms are to be interpreted in a restrictive manner.

Figure 1:
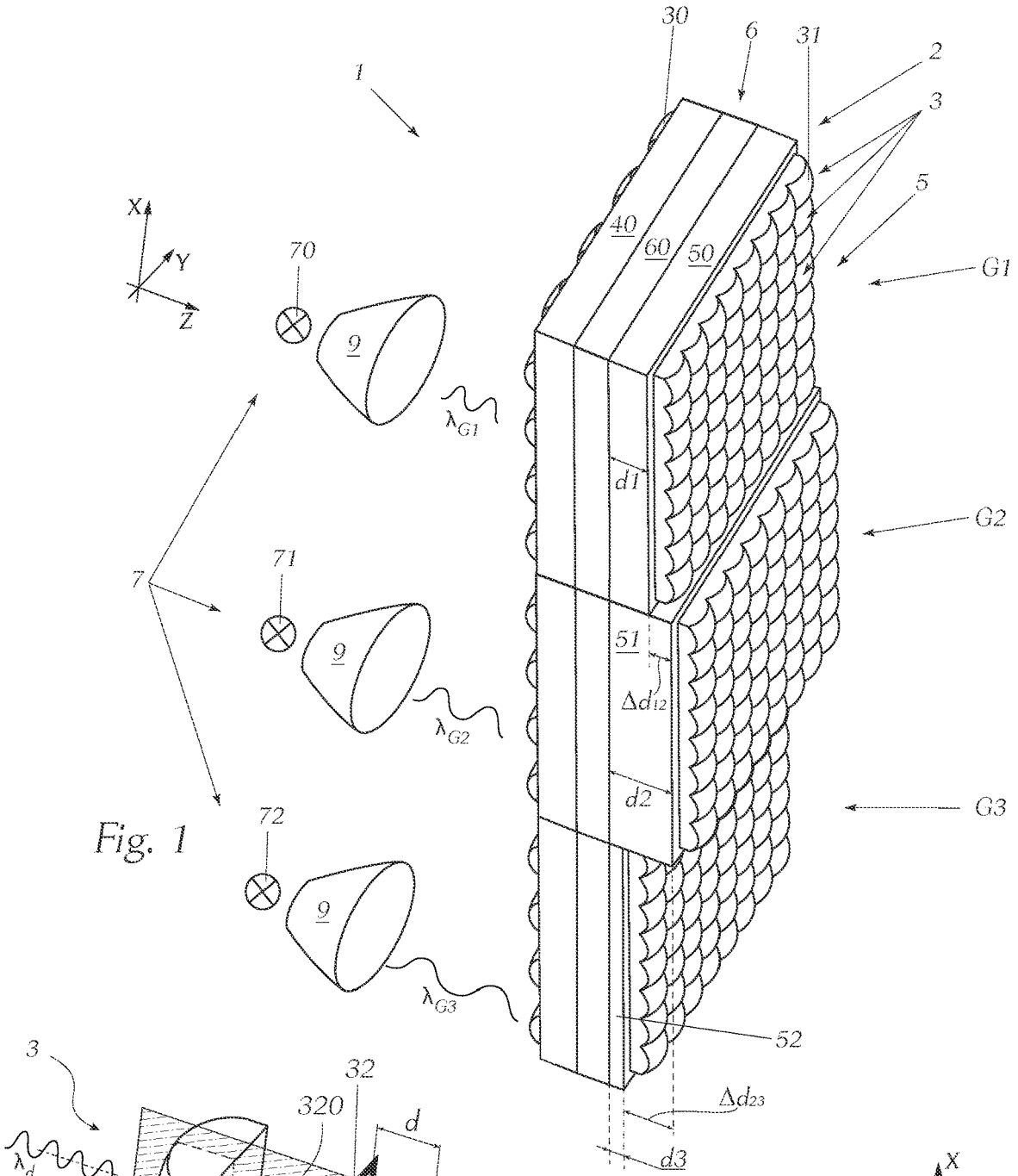

FIG. 1 shows an illumination device 1 for a motor vehicle headlamp, which can correspond to the lighting module in accordance with the invention. The lighting device 1 comprises a projection apparatus 2 formed by a plurality of micro-optical systems 3 arranged in a matrix, wherein each micro-optical system 3 has a micro-input optical element 30, a micro-output optical element 31 associated with the micro-input optical element 30, and a micro-diaphragm 32 arranged between the micro-input optical element 30 and the micro-output optical element 31. FIG. 1 shows that the matrix-like arrangement of the micro-optical systems 3 extends in two directions X (horizontal) and Y (vertical), which are substantially orthogonal to the main radiation direction Z. The coordinate system shown in FIGS. 1, 1*a* and 1*b* is, as described above, related to the illumination device 1 in its customary installation position.

Figure 6:
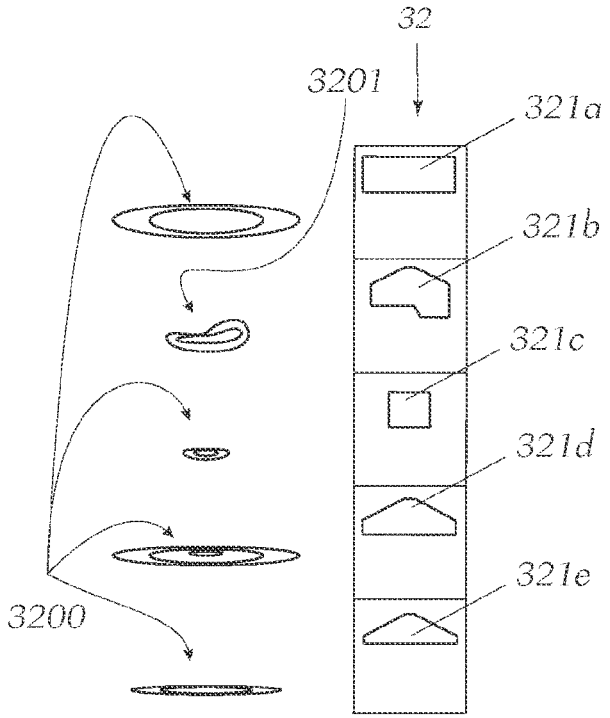
FIG. 6 shows various forms of micro-diaphragms and micro-light distributions.
Figure 7:
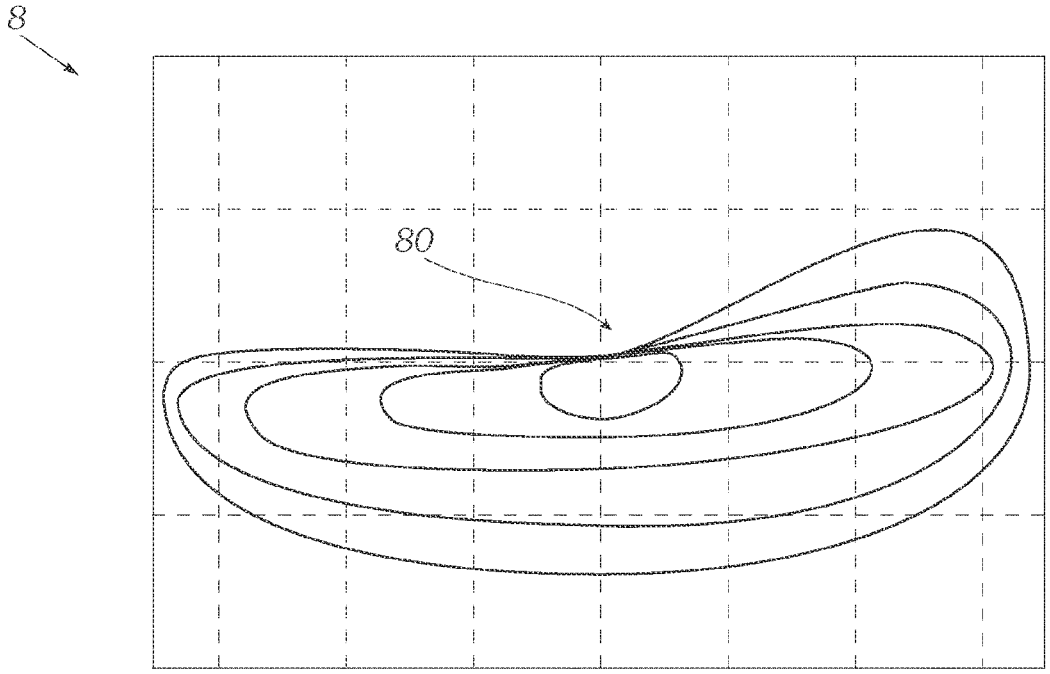
FIG. 7 shows a dipped beam distribution with an asymmetric bright/dark boundary.

The lighting device 1 can be used to generate light distributions that are formed as a superposition of a plurality of micro-light distributions (as shown, for example, in FIG. 6)—light distributions that are shaped by individual micro-optical systems. FIG. 7 shows an example of such a light distribution, which is designed as a dipped beam light distribution 8 with a bright/dark boundary with an asymmetric slope 80. If micro-optical systems are combined into certain micro-optical system groups (see below or above), each micro-optical system group is set up so as to shape a partial light distribution. The partial light distributions are also superpositions of a plurality of micro-light distributions. The light distribution, that is to say, the complete light distribution, is a superposition of partial light distributions.

Figure 1A:
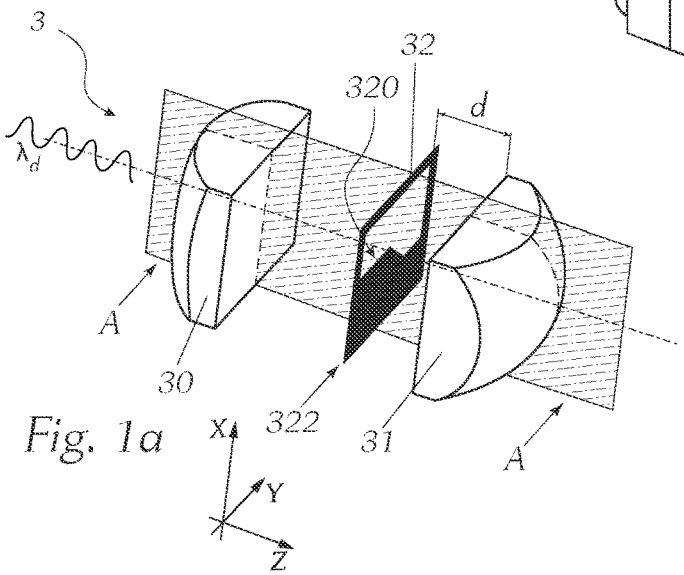
Figure 1B:
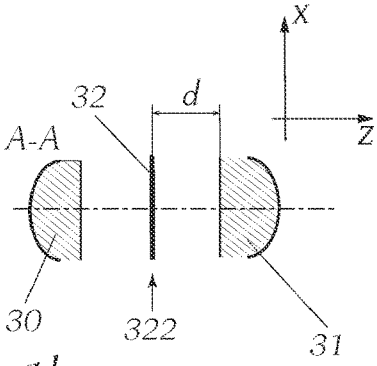

Each micro-optical system 3 preferably consists of exactly one micro-input optical element 30, exactly one micro-output optical element 31, and exactly one micro-diaphragm 32 (FIG. 1*a*). Here, all micro-input optical elements 30 form, for example, a one-piece input optical unit 4. Similarly, all micro-output optical elements 31 form, for example, a one-piece output optical unit 5, and the micro-diaphragms 32 form, for example, a one-piece diaphragm device 6. Thus, the input optical unit 4, the output optical unit 5, and the diaphragm device 6 form, for example, a one-piece projection apparatus 2. However, it is quite conceivable that the projection apparatus 2 is not formed in one piece. The micro-input optical elements 30, the micro-output optical elements 31, and the micro-diaphragms 32 can, for example, be mounted on one or more substrates 40, 50, 51, 52, 60, preferably transparent to light, and made, for example, of glass or plastic.

The diaphragm device 6 is arranged in a plane substantially orthogonal to the main radiation direction Z of the projection apparatus 2—in the intermediate image plane 322. Thus, all micro-diaphragms 32 are also located in the intermediate image plane 322. The input optical unit 4, the output optical unit 5, and the diaphragm device 6, are arranged in planes substantially parallel to each other.

FIG. 1*a* shows schematically an enlarged exploded view of one of the micro-optical systems 3 of FIG. 1. FIG. 1*b* shows the cross-section A-A of FIG. 1*a*. The substrates 40, 50, 51, 52, 60 have been omitted in this illustration for simplicity. FIG. 1*a* shows that the micro-diaphragm 32 can have an optically active edge 320. The micro-diaphragm 32 is spaced apart from the micro-output optical element 31 by a distance d. The optically active edge 320 can be set up and designed so as to generate a bright/dark boundary of the micro-light distribution—a so-called micro-bright/dark boundary 3200, 3201 (see FIG. 6). At this point, reference should be made to FIG. 6. FIG. 6 shows various shapes of the optically active edges 320*a*, 320*b*, 320*c*, 320*d*, 320*e*, of a micro-diaphragm 32, as well as micro-light distributions corresponding to these shapes, which distributions can have, for example, a substantially horizontal micro-bright/dark boundary 3201, or a micro-bright/dark boundary with an asymmetric slope 3201.

A micro-light distribution is formed by light passing through the respective micro-optical system 3. Each micro-optical system 3 preferably shapes exactly one micro-light distribution, and vice versa: each micro-light distribution is preferably shaped by exactly one micro-optical system 3. The optically active edges 320, 320*a*, 320*b*, 320*c*, 320*d*, 320*e* can have different profiles. If the micro-diaphragm 32, as shown in FIG. 1*b*, is formed as an aperture 321, 321*a*, 321*b*, 321*c*, 321*d*, 321*e* in an otherwise opaque platelet, the optically active edge 320, 320*a*, 320*b*, 320*c*, 320*d*, 320*e*, which in this case is formed as an aperture boundary, has a closed shape (see also FIG. 6). Here at least part of the optically active edge 320, 320*a*, 320*b*, 320*c*, 320*d*, 320*e* is set up/designed so as to form the micro-bright/dark boundary 3200, 3201. In the micro-diaphragms shown in FIGS. 1*a* and 6, this is the lower part of the optically active edge 320, 320*a*, 320*b*, 320*c*, 320*d*, 320*e*.

The person skilled in the art will immediately recognise that technical features relating to the geometric shape of the light distributions (including partial light distributions and micro-light distributions) refer to a two-dimensional projection of the respective light distribution. This projection can be generated, for example, in a lighting laboratory by projecting the light distribution onto a measuring screen placed at a distance of approx. 25 metres orthogonally to the main radiation direction of a lighting module, a lighting device, or a motor vehicle headlamp, set up in a customary installation position. The above is to be applied accordingly to bright/dark boundaries (a partial or micro-bright/dark boundary).

Due to chromatic aberration, the optically active edge 320, 320*a*, 320*b*, 320*c*, 320*d*, 320*e* is only sharply imaged with light of a certain colour, that is to say, a certain wavelength.

For example, in a micro-optical system 3 with a micro-output optical element 31 having a focal length of about 0.7 mm for beams with a light wavelength of about 555 nm (light from the green spectral range), the optically active edge 320, 320*a*, 320*b*, 320*c*, 320*d*, 320*e* of the micro diaphragm 32, which is spaced apart from the micro-output optical element 31 by this focal length (the distance d is equal to the focal length in this case), is imaged in the form of a micro-bright/dark boundary with a violet colour fringe if the micro-optical system is irradiated with white light, for example from a semiconductor-based light source, preferably an LED light source. The violet colour of the colour fringe is caused by a mixture of blue and red components of the white light. By a displacement of the micro-diaphragm 32 along the main radiation direction Z, the distance d is altered. This also alters the colour of the colour fringe, because the micro-diaphragm is no longer located at a point of intersection of the green beams (light beams with a light wavelength in the green spectral range) with the optical axis of the micro-diaphragm optical element, but rather, for example, at a point of intersection of the red or blue (light) beams with the optical axis of the micro-output optical element. The distance d can therefore be selected as a function of the light wavelength $\lambda_d$. This example allows a general statement to be made: if all micro-optical systems of the projection apparatus are identical, bright/dark boundaries of a light distribution generated with the projection apparatus, for example a bright/dark boundary of a dipped beam light distribution, exhibit a colour fringe in a colour that depends on the distance d of the micro-diaphragms from the micro-output optical elements. The colour of this colour fringe results from the mixing of light of the light wavelengths for which the micro-diaphragms do not lie in the focal plane (chromatic aberration).

In order to counteract, and compensate for, the problem of colour fringing, the entirety of the micro-optical systems 3 is divided into at least two micro-optical system groups G1, G2, G3. For example, FIG. 1 shows three micro-optical system groups G1, G2, G3. Each micro-optical system group G1, G2, G3 is assigned a predefined light wavelength range (e.g. green region), preferably one predefined light wavelength $\lambda_{G1}$, $\lambda_{G2}$, $\lambda_{G3}$. This means that each micro-optical system group comprises micro-optical systems whose micro-diaphragms can be sharply imaged only by light having light wavelengths $\lambda_{G1}$, $\lambda_{G2}$, $\lambda_{G3}$ from the predefined light wavelength range, preferably by light of a predefined light wavelength (e.g. of about 555 nm). In accordance with the invention, the predefined light wavelength ranges, preferably the predefined light wavelengths $\lambda_{G1}$, $\lambda_{G2}$, $\lambda_{G3}$ of different micro-optical system groups G1, G2, G3, are different. It can be appropriate that the different light wavelength ranges do not overlap. By virtue of the above-cited sharp imaging of the micro-diaphragms 32, that is to say, their optically active edges 320, 320*a*, 320*b*, 320*c*, 320*d*, 320*e*, in the light of at least one light wavelength from the predefined light wavelength range, preferably the predefined light wavelength $\lambda_{G1}$, $\lambda_{G2}$, $\lambda_{G3}$, micro-bright/dark transitions or boundaries are generated in the light image, which have colour fringes in different colours. By the superposition of the micro-bright/dark transitions or boundaries, the colour fringes in the light image are also superposed, whereby a colour compensation effect is achieved, in which the colour of a colour fringe is adapted to the summated light distribution, that is to say, to the complete light distribution. The predefined light wavelength ranges, in particular the predefined light wavelengths, are preferably selected in such a way that a white colour fringe is created.

The micro-diaphragms 32 of each micro-optical system group G1, G2, G3 can be combined into a micro-diaphragm group, wherein the micro-diaphragm groups can be of identical design.

Furthermore, provision can be made that in each micro-optical system 3 at least some of the micro-diaphragms 32 are spaced apart from the micro-output optical elements 31 by a distance d, d1, d2, d3, wherein the distance d, d1, d2, d3 depends on a light wavelength $\lambda_d$, $\lambda_{G1}$, $\lambda_{G2}$, $\lambda_{G3}$ from a predefined light wavelength range, or from one of the predefined light wavelength ranges, and is substantially the same within the same micro-optical system group G1, G2, G3. The distances d1, d2, d3 can be chosen to be different for the micro-optical systems 3 from different micro-optical system groups G1, G2, G3. This means that within one and the same micro-optical system group G1, G2, G3 the micro-diaphragms 32 are spaced apart from the respective micro-output optical elements by the same distance, wherein this distance d1, d2, d3 is selected in accordance with a light wavelength from the predefined light wavelength range assigned to this micro-optical system group G1, G2, G3, preferably the predefined light wavelength $\lambda_{G1}$, $\lambda_{G2}$, $\lambda_{G3}$. Here, the micro-optical systems 3 from two or more different micro-optical system groups G1, G2, G3 have two or more different distances d1, d2, d3 between their micro-diaphragms 32 and the respective micro-output optical elements 31. Each micro-optical system group G1, G2, G3 is set up so as to sharply image micro-diaphragms 32 in the light of the at least one light wavelength from a predefined light wavelength range, preferably one predefined light wavelength.

In the example cited above concerning the violet colour fringe, the micro-diaphragm is sharply imaged by green light of the light wavelength of approx. 555 nm.

The differences $\Delta_{d12}$, $\Delta_{d23}$ between the distances d1, d2, d3 in different micro-optical system groups G1, G2, G3 can be about 0.01 mm to about 0.12 mm, preferably from about 0.01 mm to about 0.06 mm, in particular from about 0.01 mm to about 0.03 mm. Here the micro-optical elements 31 for green light, in particular for light with a wavelength of about 555 nm, preferably have a focal length of about 0.7 mm.

It should be noted at this point that the position of the micro-diaphragms in a micro-optical systems group can be tuned to a predefined range of light wavelengths associated with that micro-optical systems group, preferably to one light wavelength. For example, if the micro-optical system group is to image the micro-diaphragms for green light (from the green region of the spectrum with light wavelengths from about 490 nm to about 575 nm: $\lambda$~490-575 nm, in particular $\lambda$~555 nm), the position of the intermediate image plane for these wavelengths is determined, and the micro-diaphragms of the micro-optical system group are then positioned in the green intermediate image plane, that is to say, at the point of intersection of the green beams with the optical axis of the micro-output optical elements.

In doing so, the micro-diaphragms have a distance from the micro-output optical elements that is tuned to the green light, and is thus related to the corresponding light wavelength.

In another micro-optical system group, the position of the micro-diaphragms is determined as a function of the light wavelength from another light wavelength region of the spectrum. Other regions of the spectrum are for example: the violet region (violet light) with a light wavelength from about 380 nm to about 420 nm (λ~380-420 nm); the blue region (blue light) with a light wavelength from about 420 nm to about 490 nm (λ~420-490 nm); the yellow region (yellow light) with a light wavelength from about 575 nm to about 585 nm (λ~575-585 nm); the orange region (orange light) with a light wavelength from about 585 nm to about 650 nm (λ~585-650 nm), and the red region (red light) with a light wavelength from about 650 nm to about 750 nm (λ~650-750 nm).

Thus, the optically active edges 320, 320*a*, 320*b*, 320*c*, 320*d*, 320*e* within the same micro-optical system group can be sharply imaged with light from a predefined light wavelength range, preferably one predefined light wavelength. That is to say, the bright/dark transition(s), for example bright/dark boundary(ies), generated by the optically active edges 320, 320*a*, 320*b*, 320*c*, 320*d*, 320*e* exhibit(s) a colour fringe of a corresponding colour. With reference to the above-cited example, a displacement of the micro-diaphragm (green focal point), which is spaced apart approx. 0.7 mm from the micro-optical elements, by approx. 0.06 mm in the horizontal direction towards the micro-optical elements, or away from the micro-optical elements, results in a red or blue colour fringe at the micro-bright/dark transition or boundary. For example, by a displacement of the micro-diaphragm by 0.03 mm towards the micro-optical element (or the micro-optical element towards the micro-diaphragm), an orange-coloured colour fringe is created). A superposition of the colour fringes in different colours in the light image leads to a clear compensation for the colour fringe. For example, a yellow-reddish colour fringe can be superposed with a violet colour fringe and can thus generate a substantially white colour fringe—compensation. This can be achieved, for example, with a projection apparatus comprising two micro-optical system groups consisting of an equal number of the micro-optical systems, wherein the micro-output optical elements of one micro-optical system group are approximately 0.06 mm thicker than those of the other. The sharpness factor of the light distribution can then be adapted.

The different distances d1, d2, d3 in the different micro-optical system groups G1, G2, G3 can be caused, for example, by different thicknesses of the micro-output optical elements 32 themselves, of the corresponding substrates, or of the corresponding adhesive layers between the corresponding substrate and the micro-output optical elements.

FIG. 1 shows that the micro-output optical elements 32 are applied onto a substrate 50, 51, 52. Here the thickness of the substrate 50, 51, 52 varies, depending on the micro-optical system group G1, G2, G3. The thickness of the substrate 50, 51, 52 in the corresponding micro-optical system group G1, G2, G3 defines the distances d1, d2, d3 between the micro-diaphragms 32 and the micro-output optical elements 31 of this micro-optical system group G1, G2, G3. It is also conceivable to design the substrate 60 of the diaphragm device 6 or the substrate 40 of the input optical unit 4 with different thicknesses for the different micro-optical system groups G1, G2, G3.

Figure 2:
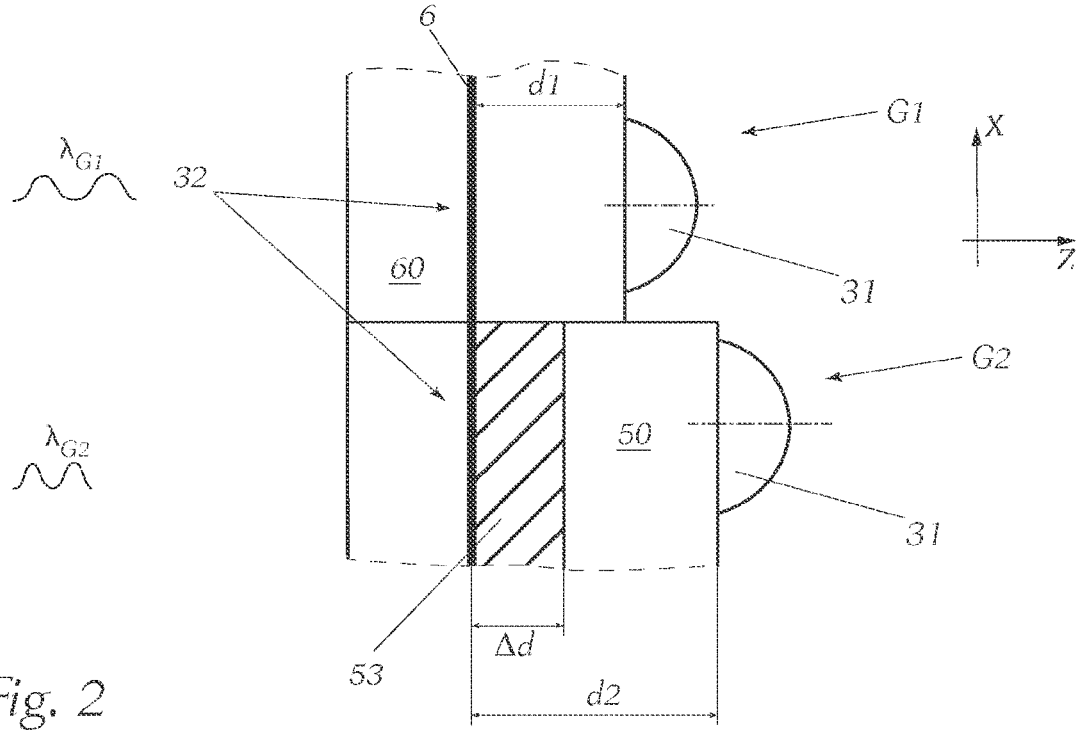
FIGS. 2 and 3 show micro-optical system groups with differently spaced apart micro-diaphragms and micro-output optical elements.
Figure 3:
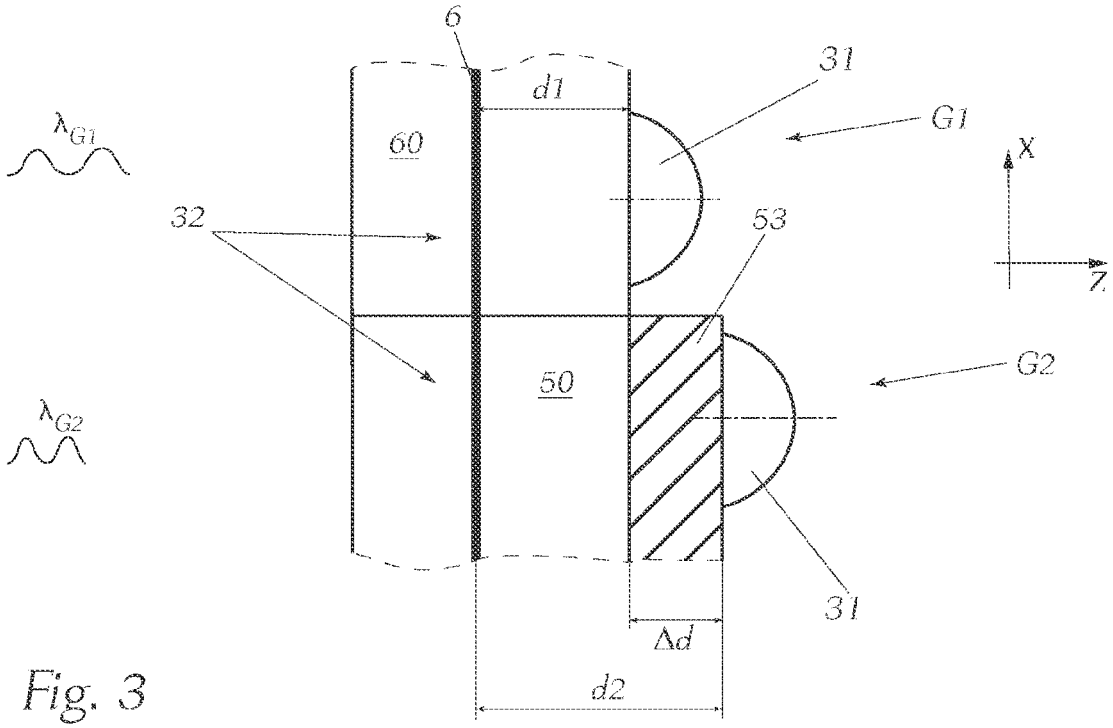

FIGS. 2 and 3 show that the different distances d1, d2, d3 can also be achieved with an adhesive layer 53 of a thickness d, for example from 0.01 mm to about 0.12 mm, preferably from about 0.01 mm to about 0.06 mm, in particular from about 0.01 mm to about 0.03 mm. Here this somewhat thicker adhesive layer can be located, for example, between the micro-output optical elements 31 and the substrate 50 of the output optical unit 5, or between the micro-diaphragms 32 and the substrate 50 of the output optical unit 5.

Figure 4:
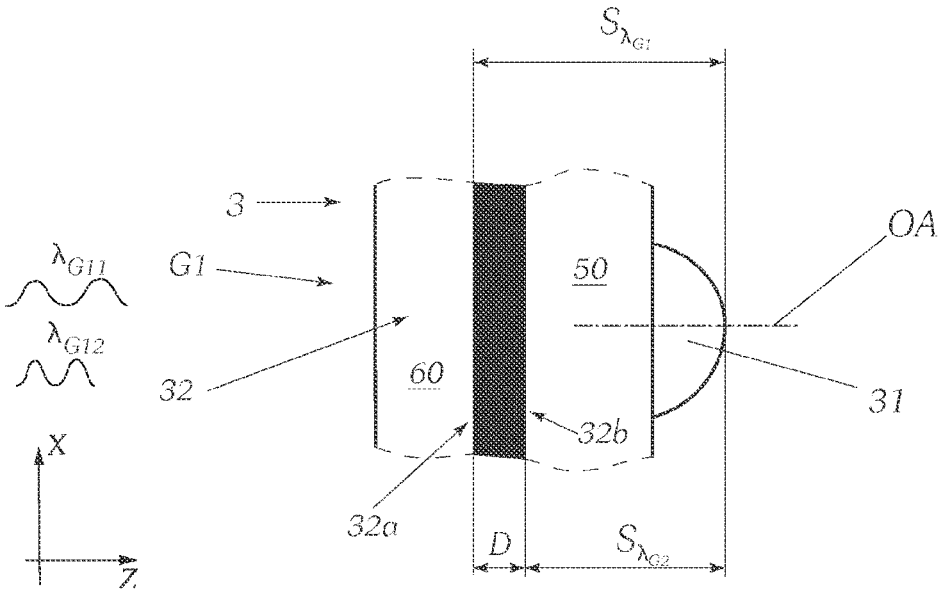
FIG. 4 shows a micro-optical system with a finitely thick micro-diaphragm.

Furthermore, it is conceivable (see FIG. 4) to produce the micro-diaphragms of a thickness D so that, for example, a rear part 32*a* of their optically active edges, distal with respect to the micro-optical elements 31 (in the main radiation direction Z), is sharply imaged with light of a first light wavelength $\lambda_{G11}$ from the predefined light wavelength range, and a front part 32*b* of their optically active edges, proximal with respect to the micro-optical elements 31, is sharply imaged with light of a second light wavelength $\lambda_{G12}$ from the predefined light wavelength range. That is to say, the distal part 32*a* is located at a point of intersection $S_{\lambda G11}$ of the beams of light wavelength $\lambda_{G11}$ with the optical axis OA of the micro-optical system 3, and the proximal part 32*b* is located at a point of intersection $S_{\lambda G12}$ of the beams of light wavelength $\lambda_{G12}$ with the optical axis OA of the micro-optical system 3.

With reference to the above example of the micro-optical system with a micro-output optical element 31, which has a focal length of about 0.7 mm for beams with a light wavelength of about 555 nm (light from the green spectral region), the micro-diaphragm 32 can be about 0.12 mm thick, wherein its centre can be spaced apart from the micro-output optical element 31 by about 0.7 mm. Here the distal part 32*a* of the optically active edge of the micro-diaphragm 32 will be located at a point of intersection $S_{\lambda G11}$ of the red beams with the optical axis OA of the micro-output optic 31, and the proximal part 32*b* of the optically active edge of the micro-diaphragm 32 will be located at a point of intersection $S_{\lambda G12}$ of the blue beams with the optical axis OA of the micro-output optical element. Different parts of the optically active edge, such as the distal or the proximal part, are superposed in the form of micro-bright/dark transitions or boundaries, with colour fringes in different colours in the light image. This superposition can also compensate for the colour fringing of the bright/dark boundary.

However, in terms of simplicity of production, micro-output optical elements of different thicknesses—whether achieved by a thicker substrate, a thicker adhesive layer, or a thicker micro-output optical element body—are preferred. Production of micro-diaphragms of different thicknesses is only possible with deposition processes (lithographic processes) and results in an air gap in the projection apparatus. Micro-diaphragms of different thicknesses cannot be joined with flat glass plates, such as those used in the imprint process. However, micro-output optical elements of different thicknesses (corresponding to a displacement of the refractive surface) can be easily produced using tools.

Furthermore, provision can be made that the micro-output optical element 31 of each micro-optical system 3 has a light-output surface with a predefined curvature k1, k2, wherein the predefined curvature k1, k2 (the value of the predefined curvature) depends on a light wavelength from a predefined light wavelength range or from one of the predefined light wavelength ranges, preferably on one of the light wavelengths $\lambda_{G1}$, $\lambda_{G2}$, $\lambda_{G3}$, and is substantially the same within the same micro-optical system group G1, G2, G3, wherein the predefined curvatures k1, k2 are different for the micro-optical systems 3 from different micro-optical system groups G1, G2, G3.

Figure 5:
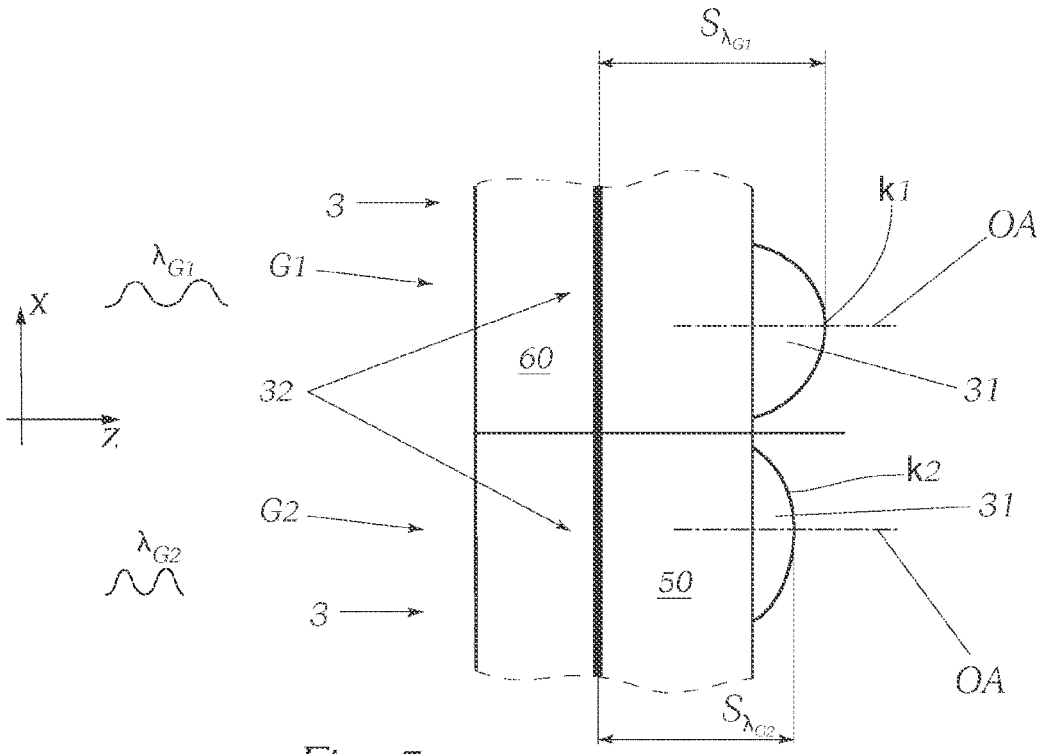
FIG. 5 shows micro-optical system groups with differently curved light-output surfaces of the micro-output optical elements.

By altering the curvatures k1, k2 of the light-output surfaces of the micro-output optical elements 31, the focal lengths (for all colours) of the micro-output optical elements 31 can be altered. The micro-optical systems 3 with micro-output optical elements 31, which have differently curved light-output surfaces, therefore have different focal lengths for a predefined light wavelength h. FIG. 5 shows schematically two micro-optical elements 31 from different micro-optical system groups G1, G2, and micro-diaphragms 32 located in front of these micro-optical elements 31. Here it should be noted that in this example the micro-diaphragms are arranged at the same distance from the micro-output optical elements 31. It is to be understood that this is not a limitation. The distance between the micro-diaphragm and the micro-output optical element can also be varied here, as described above, and adapted to the light wavelength. The light-output surfaces of the micro-output optical elements 31 of FIG. 5 have different curvatures. This means that the micro-diaphragms 32 of the micro-optical systems 3 of a first micro-optical system group G1 can be located at a point of intersection $S_{\lambda G1}$ of the beams of light wavelength $\lambda_{G1}$ with the optical axis OA of the corresponding micro-optical system 3, and the micro-diaphragms 32 of the micro-optical systems 3 of a second micro-optical system group G2 can be located at a point of intersection $S_{\lambda G2}$ of the beams of light wavelength $\lambda_{G2}$ with the optical axis OA of the corresponding micro-optical system 3. As a result, the optically active edges of the micro-diaphragms 32 are depicted as micro-bright/dark transitions or boundaries 3200, 3201 with colour fringes in different colours. As already cited, the light wavelengths can be selected in such a way that the colour fringe resulting from the superposition is white.

It is to be understood that these examples of embodiment can be combined with one another. For example, it can be appropriate not only to vary the position of the micro-diaphragms (the distance d1, d2, d3 between the micro-diaphragm and the respective micro-output optical elements) from micro-optical system group to micro-optical system group, but also to alter the curvatures k1, k2 of the light-output surfaces of the micro-output optical elements. For example, the overall thickness of the projection apparatus, but also the longitudinal extent of the whole lighting module, in which the projection apparatus is used, can be influenced and thus, for example, the build depth can be adapted. In the micro-optical systems 3 of FIG. 5, for example, it is perfectly conceivable to provide an adhesive layer as in FIG. 2 or 3, or a thicker substrate as in FIG. 1.

As cited above, FIG. 6 shows examples of micro-diaphragms 32 with differently shaped apertures 321*a*, 321*b*, 321*c*, 321*d*, 321*e*, and examples of micro-light distributions, which can be generated by the respective shape of the aperture. Figure shows two different shapes of micro-bright/dark boundaries: a micro-bright/dark boundary 3201 extending substantially horizontally, and a micro-bright/dark boundary with an asymmetric slope 3201. As explained above, a superposition of the micro-light distributions of the same micro-optical system group in the light image forms a partial light distribution, which has a partial-bright/dark boundary with a colour fringe of a predefined colour, wherein the predefined colour depends on the predefined light wavelength range, preferably on the predefined light wavelength. The partial light distributions superposed in the light image form a light distribution, that is to say, a complete light distribution, such as the dipped beam light distribution 8 in FIG. 7. The micro-light distributions with the micro-bright/dark boundaries having the asymmetric slope 3201 lead to partial-bright/dark boundaries with an asymmetric slope, wherein each partial-bright/dark boundary has the colour fringe in the predefined colour. By this means, the bright/dark boundary with the asymmetric slope 80 is formed, the colour fringe of which has a colour determined by the colours of the colour fringes of the partial light distribution. The colour of the colour fringe of the bright/dark boundary with the asymmetrical slope 80 is preferably white in the case of the dipped beam distribution 8.

Although this is not shown in the figures, the different micro-optical system groups can be designed completely separately from each other. Here it is conceivable that the different micro-optical system groups are spaced apart from each other. The input optical unit, the output optical unit, and the diaphragm device can here be arranged on different separate, preferably translucent, substrates.

Furthermore, it can be seen from FIG. 1 that the lighting device 1 for a motor vehicle headlamp is equipped with a light source 7, which is located upstream of the projection apparatus 2 in the light emission direction Z. The light source 7 emits light, which is projected by means of the projection apparatus 2 into a region in front of the lighting device in the form of a light distribution, for example a dipped beam light distribution 8 with a bright/dark boundary, for example a bright/dark boundary with an asymmetric slope 80.

As cited above, the light distribution is formed by a number of overlapping partial light distributions, each with a partial bright/dark boundary. Each partial light distribution is formed by exactly one micro-optical system group.

The light source 7 can appropriately be set up so as to generate collimated light.

For example, the light source 7 can comprise a light-collimating optical element, such as a collimator 9 in FIG. 1, and a preferably semiconductor-based light element, such as an LED light source 10, located upstream of the collimator 9. The light-collimating optical element can also be designed as a light-collimating optical attachment, or a TIR lens (not shown).

Furthermore, it can be seen in FIG. 1 that the light source has three light-emitting regions 70, 71, 72. Each individual light-emitting region can be one or a plurality of semiconductor-based light sources, preferably LED light sources, and can be controlled, for example, can be switched on and off, independently of the other light-emitting regions of the light source 7. Furthermore, it can be appropriate to assign at least one, preferably exactly one, micro-optical system group G1, G2, G3 to each light-emitting region 70, 71, 72 in such a way that light generated by the respective light-emitting region 70, 71, 72 impinges directly and only onto the micro-optical system group G1, G2, G3 assigned to this light-emitting region 70, 71, 72.

The above discussion of the invention has been presented for purposes of illustration and description. The above is not intended to limit the invention to the form or forms disclosed herein. For example, the above detailed description summarises various features of the invention in one or a plurality of forms of embodiment for the purpose of shortening the disclosure. This type of disclosure is not to be understood as reflecting the intention that the claimed invention requires more features than are expressly cited in each claim. Rather, as the following claims reflect, inventive aspects are present in fewer than all features of a single form of embodiment described above.

Furthermore, although the description of the invention includes a description of one or a plurality of forms of embodiment, and certain variations and modifications, other variations and modifications are within the scope of the invention, e.g. within the ability and knowledge of persons skilled in the art, according to the understanding of the present disclosure.

The reference symbols in the claims serve only to facilitate the understanding of the present inventions, and in no way imply any limitation of the present inventions.

The invention claimed is:

1. A lighting module (1) for a motor vehicle headlamp, the lighting module comprising:

a light source (7); and a projection apparatus which comprises:

a plurality of micro-optical systems (3) arranged in a matrix-like manner, wherein each micro-optical system (3) has a micro-input optical element (30), a micro-output optical element (31) associated with the micro-input optical element (30), and a micro-diaphragm (32), wherein all the micro-input optical elements (31) form an input optical unit (4), all the micro-output optical elements (31) form an output optical unit (5), and the micro-diaphragms (32) form a diaphragm device (6), wherein the diaphragm device (6) is arranged in a plane substantially orthogonal to the main radiation direction (Z) of the projection apparatus (2), and the input optical unit (4), the output optical unit (5), and the diaphragm device (6), are arranged in planes substantially parallel to each other, wherein the entirety of the micro-optical systems (3) is divided into at least two micro-optical system groups (G1, G2, G3), and wherein the micro-diaphragms (32) of the micro-optical systems (3) of each of the at least two micro-optical system group (G1, G2, G3) can be sharply imaged by light of at least one light wavelength ($\lambda_{G1}$, $\lambda_{G2}$, $\lambda_{G3}$) from a predefined light wavelength range, and the predefined light wavelength ranges are different for different ones of the at least two micro-optical system groups (G1, G2, G3);

wherein the projection apparatus (2) is arranged downstream of the light source (7) in the light radiation direction, and is configured to project light generated by the light source (7) into a region in front of the lighting module in the form of a light distribution (8) with a bright/dark boundary (80), wherein the light distribution is formed by a plurality of overlapping partial light distributions, each with a partial bright/dark boundary, and each partial light distribution is formed by exactly one micro-optical system group, wherein each partial bright/dark boundary has a color fringe of a predefined color, and different partial bright/dark boundaries have color fringes of different colors, and each color corresponds to a light wavelength ($\lambda_{G1}$, $\lambda_{G2}$, $\lambda_{G3}$) from a predefined light wavelength range, and wherein the color fringes are overlayed to form a white color fringe.

2. The lighting module according to claim 1, wherein:

in each micro-optical system (3) at least a part of the micro-diaphragm (32) is spaced apart from the micro-output optical element (31) by a distance (d, d1, d2, d3), the distance (d, d1, d2, d3) depends on the at least one light wavelength ($\lambda_d$, $\lambda_{G1}$, $\lambda_{G2}$, $\lambda_{G3}$) from a predefined light wavelength range, and is the same within the same micro-optical system group (G1, G2, G3), and the distances (d1, d2, d3) are different for the micro-optical systems (3) from different micro-optical system groups (G1, G2, G3).

3. The lighting module according to claim 2, wherein:

differences ($\Delta_{d12}$, $\Delta_{d23}$) between the distances (d1, d2, d3) in different micro-optical system groups (G1, G2, G3) amount to about 0.01 mm to about 0.12 mm, and the micro-output optical elements (31) have a focal length which depends on the at least one light wavelength ($\lambda_d$, $\lambda_{G1}$, $\lambda_{G2}$, $\lambda_{G3}$) from a predefined light wavelength range, and on the diameter of the respective micro-output optical element (31).

4. The lighting module according to claim 1, wherein:

the micro-output optical element (31) of each micro-optical system (3) has a light-output surface with a predefined curvature (k1, k2), the predefined curvature (k1, k2) depends on the at least one light wavelength ($\lambda_{G1}$, $\lambda_{G2}$, $\lambda_{G3}$) from a predefined light wavelength range and is the same within the same micro-optical system group (G1, G2, G3), and the predefined curvatures (k1, k2) are different for the micro-optical systems (3) from different micro-optical system groups (G1, G2, G3).

5. The lighting module according to claim 1, wherein at least some of the micro-diaphragms (32) of each micro-optical system group (G1, G2, G3) have edges (320, 320*a*, 320*b*, 320*c*, 320*d*, 320*e*), which are designed to image a substantially horizontal micro-bright/dark boundary.

6. The lighting module according to claim 5, wherein the micro-bright/dark boundaries can be sharply imaged for different micro-optical system groups by light of the different light wavelengths ($\lambda_{G1}$, $\lambda_{G2}$, $\lambda_{G3}$).

7. The lighting module according to claim 1, wherein the different micro-optical system groups (G1, G2, G3) are designed separately from each other, and are spaced apart.

8. The lighting module according to claim 1, wherein:

the micro-diaphragms (32) of each micro-optical system group (G1, G2, G3) are combined to form a micro-diaphragm group, and the micro-diaphragm groups are of identical design, each micro-diaphragm (32) is designed as a platelet of an opaque material with an aperture (321, 321*a*, 321*b*, 321*c*, 321*d*, 321*e*), and each micro-diaphragm (32) has a finite thickness (D) along the main radiation direction (Z).

9. The lighting module according to claim 1, wherein the partial bright/dark boundaries and the bright/dark boundary run substantially straight or have an asymmetric slope (80).

10. The lighting module according to claim 1, wherein the light source (7) is configured to generate collimated light.

11. The lighting module according to claim 1, wherein the light source (7) comprises a light-collimating optical element (9) and a semiconductor-based lighting element (10).

12. The lighting module according to claim 1, wherein the light source (7) has at least two light-emitting regions (70, 71, 72), wherein each individual light-emitting region can be controlled independently of the other light-emitting regions of the light source (7), for example can be switched on and off, and at least one, preferably exactly one, micro-optical system group (G1, G2, G3) is assigned to each light-emitting region (70, 71, 72) in such a way that light generated by the respective light-emitting region (70, 71, 72) impinges directly and only onto the micro-optical system group (G1, G2, G3) assigned to this light-emitting region (70, 71, 72).

13. A motor vehicle headlamp comprising at least one lighting module according to claim 1.

14. The lighting module according to claim 3, wherein the differences ($\Delta_{d12}$, $\Delta_{d23}$) between the distances (d1, d2, d3) in different micro-optical system groups (G1, G2, G3) range from about 0.01 mm to about 0.06 mm.

15. The lighting module according to claim 14, wherein the differences ($\Delta_{d12}$, $\Delta_{d23}$) between the distances (d1, d2, d3) in different micro-optical system groups (G1, G2, G3) range from about 0.01 mm to about 0.03 mm.

16. The lighting module according to claim 8, wherein the finite thickness (D) along the main radiation direction (Z) is about 0.01 mm to about 0.12 mm.

17. The lighting module according to claim 16, wherein the finite thickness (D) along the main radiation direction (Z) is about 0.06 mm.

18. The lighting module according to claim 11, wherein:

the semiconductor-based lighting element (10) is an LED light source, and/or the light-collimating optical element (9) is a collimator, a light-collimating optical attachment, or a TIR lens.

* * * * *